United States Patent [19]

Lawson

[11] 4,096,869

[45] Jun. 27, 1978

[54] FORMULATION FOR THE DISSOLUTION OF GYPSUM

[75] Inventor: Michael B. Lawson, Duncan, Okla.

[73] Assignee: Halliburton Company, Duncan, Okla.

[21] Appl. No.: 794,277

[22] Filed: May 5, 1977

[51] Int. Cl.[2] ..... C23G 1/02

[52] U.S. Cl. ..... 134/3; 252/82; 252/86; 252/87; 166/311; 166/312; 252/8.55 B; 134/2

[58] Field of Search ..... 252/8.55 B, 82, 86, 252/87; 166/311, 312; 134/2, 3

[56] References Cited

U.S. PATENT DOCUMENTS

| | | | |
|---|---|---|---|
| 3,696,040 | 10/1972 | Mayo | 252/86 X |
| 3,706,669 | 12/1972 | Gardner | 252/82 |
| 3,793,209 | 2/1974 | Thompson | 252/82 |
| 3,808,143 | 4/1974 | Gardner | 252/82 X |
| 3,948,976 | 4/1976 | Suen et al. | 252/82 |
| 3,951,827 | 4/1976 | Burroughs | 252/8.55 B |

*Primary Examiner*—Benjamin R. Padgett
*Assistant Examiner*—Josephine L. Barr
*Attorney, Agent, or Firm*—Thomas R. Weaver; John H. Tregoning

[57] ABSTRACT

A method for dissolving and/or disintegrating gypsum comprising contacting said gypsum with an aqueous solvent containing as an active agent an hydroxamic acid and/or certain salts thereof.

10 Claims, No Drawings

FORMULATION FOR THE DISSOLUTION OF GYPSUM

This invention relates to the removal of scale deposits from substrates. It further relates to the chemical removal of calcium sulfate scale from metallic substrates and earthen formations. This invention still further relates to a composition for and a method of chemically removing gypsum from industrial process equipment, oil field equipment, earthen formations and other substrates.

Throughout this disclosure, illustrative examples, and appended claims, there is made frequent reference to the word "gypsum". Gypsum is accordingly defined as the calcium sulfate compound having two waters of hydration ($CaSO_4 \cdot 2H_2O$).

Deposits of gypsum frequently form in industrial, commercial and home water systems, and also in subterranean formations used as a source of water and hydrocarbons. Such deposits are generally undesirable because they can restrict fluid flow, reduce heat exchange capacity, or cause some other adverse effect on the operational efficiency of equipment.

Gypsum deposits are found, for example, in producing wells, injection wells, waste disposal systems, boilers and other heat exchange equipment. Deposits of gypsum can significantly reduce the flow of oil and/or water into a well bore by plugging off perforations in the tubing and/or casing. In addition, downhole pumps can become stuck as a result of gypsum scale deposition. Gypsum deposits can form on the surface of tubular goods in a well in such a manner as to severely impede production of fluids.

Carbonate solutions have been used to convert gypsum to calcium carbonate, which can then be attacked by an acid to yield carbon dioxide and a soluble acid salt. This method has the disadvantage of requiring the use of an acid to dissolve the calcium carbonate. This method also exhibits reduced effectiveness on dense, laminated gypsum scales, the removal of which requires repeated treatments with the carbonate composition and repeated washings with an acid. Acids are generally undesirable in that they can be corrosive to the system from which the gypsum deposit is sought to be removed.

Various hydroxides have been used with some effectiveness to remove gypsum deposits. The hydroxide converts the gypsum to calcium hydroxide which is soluble in an acid. In certain cases, the calcium hydroxide is in the form of a sludge which can be pumped or washed away from the system or formation, while in other instances, an acid must be used to dissolve the reaction precipitate before it can be removed. Although a degree of success has been obtained with the hydroxides, the hydroxides in some cases tend to decrease in effectiveness with repeated treatments, partially because of a buildup of the calcium hydroxide sludge within the system and because of the hydroxide coating formed on the surface of the gypsum deposit. In addition, the hydroxide method sometimes requires the use of an acid to wash away the reaction precipitate which, as previously pointed out, is generally undesirable.

Potassium acetate has been used to convert gypsum to a mixture of calcium acetate and klauzite [$K_2Ca(SO_4)_2 \cdot H_2O$]. The calcium acetate is soluble to a limited extent, while the klauzite forms as a water dispersible sludge.

Still another method of dissolving gypsum scales has been to treat the scales with ethylenediaminetetraacetic acid (EDTA). A problem with the use of EDTA to remove gypsum scale from substrates is that EDTA dissolves but does not disintegrate gypsum. Furthermore, the actual dissolution of gypsum scales and deposits with EDTA requires such an extended period of time as to render unattractive its use in actual field application.

I have now invented still another method for removing gypsum deposits from substrates. By the method of my invention, the gypsum is contacted with a material which not only dissolves but also disintegrates gypsum. Thus, the present invention provides a method for the simultaneous dissolution and disintegration of gypsum. It is believed that the method of this invention can remove a larger amount of gypsum from, for example, fouled process equipment than can be removed utilizing gypsum removal methods of the prior art.

The method of the present invention comprises contacting a gypsum deposit with a solvent composition having as the active agent a material selected from the group consisting of a hydroxamic acid, an alkali metal salt of a hydroxamic acid, an amine salt of a hydroxamic acid and mixtures thereof, for a time sufficient to dissolve and/or disintegrate the gypsum deposit.

The hydroxamic acid and the named salts thereof have the ability to dissolve gypsum, and also the ability to convert gypsum not actually dissolved into a water dispersible sludge. It is thus believed that the total amount of gypsum scale rendered amenable to removal from fouled surfaces is greater than that afforded by prior methods.

One advantage of this invention is that an acid treatment is not required subsequent to the use of the solvent composition. In this connection, the dissolved scale is merely drained from the system being cleaned and the dispersible sludge is simply flushed with water from the system being cleaned.

Increased gypsum removal efficiency is another advantage of this invention. For example, at 125° F and a pH of 13, a gypsum solvent composition of this invention consisting of 20 parts by weight of potassium methylhydroxamate dissolved in 80 parts by weight of water will dissolve and/or convert to a water dispersible sludge 1.3 pounds of gypsum per gallon of solvent. In comparison, a gypsum solvent of the prior art containing 17 parts by weight potassium acetate and 83 parts by weight of water, having a pH of 8.4, and being utilized at 125° F, will remove 0.12 lbs. of gypsum per gallon of solvent. In another prior art method, sodium hydroxide at 72° F, followed by an acid, will remove only 0.50 pounds of gypsum per gallon of hydroxide solvent and, in still another prior art method, sodium carbonate at 72° F, followed by an acid, will remove only 0.35 pounds of gypsum per gallon of carbonate solution. All of the examples cited above cover treatment periods of 24 hours.

The hydroxamic acid utilized in the solvent composition is a solid material at ambient temperatures and atmospheric pressures and is selected from the group consisting of acids represented by the formula:

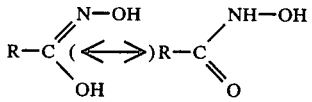

(1)

(A) (B)

wherein R is selected from hydrogen, alkyl groups having 1 to 10 carbon atoms and the group

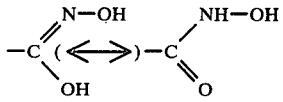

(A) (B)

It is noted that the hydroxamic acid and the salts thereof useful herein is a tautomeric compound which is believed to exist simultaneously in the forms (A) and (B) expressed in formula (1) above. However, for convenience only, the (A) form shall be utilized by itself in the remaining portions of this disclosure and in the appended claims.

The preferred hydroxamic acids for use herein are those which contain from 1 to 6 and more preferably from 2 to 6 carbon atoms. Examples of these preferred hydroxamic acids are methylhydroxamic acid, ethylhydroxamic acid, n-propylhydroxamic acid, isopropylhydroxamic acid, n-butylhydroxamic acid, t-butylhydroxamic acid, n-pentylhydroxamic acid, isopentylhydroxamic acid and neopentylhydroxamic acid. The most preferred single hydroxamic acid for use herein is methylhydroxamic acid.

Where salts of the described acids are used, or are formed in situ, the preferred cations involved in the salt formation are those derived from ammonia, ammonium hydroxide, ethylenediamine and alkali metal hydroxides. Potassium hydroxide is particularly useful. Other useful cation sources include any of the amines or alkanol amines capable of forming salts with the hydroxamic acid. Examples of the former are monoethyl amine and monomethyl amine; examples of the latter are monoethanol amine, diethanol amine, and triethanol amine.

A particularly preferred material for use in the solvent composition is the potassium salt of methylhydroxamic acid, otherwise referred to as potassium methylhydroxamate (R in equation (1) is $—CH_3$ and the hydrogen in the OH group connected to the nitrogen is replaced by a potassium atom).

In view of the foregoing, a general formula for the acid and/or salt useful herein is:

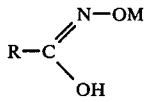

(2)

wherein R is as defined in formula (1) above and M is selected from hydrogen and any of the cations useful to form the salts such as those set out previously.

The solvent composition can also contain, as a pH adjusting material, a basic amine or an alkali metal hydroxide which is compatible with the hydroxamic acid or salt being utilized in the solvent composition. Examples of basic amines useful as pH adjusting materials include those represented by the formula

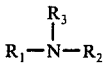

where $R_1$, $R_2$ and $R_3$ can be hydrogen atoms, alkyl groups, aryl groups, substituted alkyl or aryl groups and mixtures thereof. Examples of such amines are ammonia and triethanolamine.

Examples of alkali metal hydroxides useful as pH adjusting materials herein include those represented by the formula (MOH) where M is an alkali metal such as sodium or potassium.

As stated previously, the solvent composition of this invention consists essentially of water having dissolved therein the active material and also including a pH adjusting agent. The active material, also as stated previously, is one of the above defined hydroxamic acids and/or one of the salts thereof, and mixtures of the acid and salts and mixtures of the salts. In formulating the solvent composition, the solid active material is dissolved in water and thereafter the pH of the solution is adjusted with a suitable pH adjusting material to obtain the desired pH. The quantity of active material dissolved in water is in the range of from about 1 to about 50, preferably from about 10 to about 40, and still more preferably from about 15 to about 30 parts by weight of active material per 100 parts by weight of solution.

The water utilized to dissolve the active material can be distilled, demineralized, or ordinary tap water.

The solvent composition can be prepared before contacting the gypsum scale to be removed or the gypsum scale can be contacted with water and the active material thereafter dissolved in the water to thereby form the solvent composition. The solution of the active material in the water requires no special heating or mixing procedures; however, satisfactory results can be obtained by utilizing the following procedure:

Approximately 20 parts by weight of a mixture of methylhydroxamic acid and the potassium salt of methylhydroxamic acid are added to 80 parts by weight of water to form a solution. The pH of the solution is adjusted to 13 by the addition thereto of a concentrated solution of potassium hydroxide to thus form a solvent useful herein.

The quantity of pH adjusting material utilized is based upon the quantity required to adjust the pH of the solvent composition to a value in the range of from about 7 to about 14. A preferred pH of the solvent composition is in the range of from about 10 to about 13.5; a still further preferred pH of the solvent composition is in the range of from about 12 to about 13.

The solvent is then placed in contact with the gypsum deposit and the solvent is heated to 125° F.

In practicing the gypsum removal method of the invention, the gypsum scale or deposit is contacted with the solvent composition at a temperature in the range of from about 60° F to about 200° F. A preferred temperature range for use of the solvent composition of this invention in dissolving and/or disintegrating gypsum is in the range of from about 100° F to about 150° F. A preferred temperature for use in the method of this invention is about 125° F.

A preferred active material is a hydroxamate wherein R in formula (1) is a methyl group.

In the most preferred method for dissolving gypsum herein, the gypsum deposit is contacted with a solvent composition consisting of 20 parts by weight potassium methylhydroxamate dissolved in 80 parts by weight of water wherein the resulting solution is adjusted to a pH of 13 with potassium hydroxide and the temperature of contact is maintained at about 125° F for a time sufficient to dissolve and/or to disintegrate the gypsum deposit desired to be removed.

The preferred active material, potassium methylhydroxamate can be prepared according to the following procedure:

85 grams of potassium hydroxide (1.5 moles) is introduced into a reaction vessel containing one liter of isopropanol and 100 grams of hydroxylamine sulfate ($NH_2OH \cdot H_2SO_4$; 0.6 moles). The contents of the reaction vessel are stirred in an ice bath for about one hour. The reaction vessel is preferably closed to the atmosphere during this time period. The contents of the vessel are then filtered through a Buchner funnel and 118 mls (1.2 moles) of ethylacetate are added to the filtrate. The filtrate is then allowed to stand for 24 hours at ambient temperature (~74° F). The filtrate is then placed in a round-bottom flask and evaporated to about one-third to about one-half of the original volume. Upon cooling, a white crystalline solid is obtained that is a mixture or methylhydroxamic acid and potassium methylhydroxamate. This mixture can be recrystallized from isopropanol. By adding potassium hydroxide to a water solution of the mixture, the pure potassium methylhydroxamate can be obtained.

EXAMPLE 1

12.838 grams of methylhydroxamic acid are dissolved in 25.00 grams of water and 50.00 milliliters of 30 weight percent ammonium hydroxide. 10.686 grams of potassium hydroxide are then dissolved in the solution. 20.00 grams of powdered, reagent gypsum are next placed in the solution. The solution is able to dissolve 1.36 lbs of gypsum per gallon of solvent over a 24-hour period at 74° F temperature.

A similar run is made containing no methylhydroxamic acid; only 0.005 lb gypsum per gallon of solvent is dissolved.

EXAMPLE II 8.352 grams of methylhydroxamic acid are dissolved in 45.00 grams of water. 5.13 milliliters of potassium hydroxide solution are titrated into the solution until the resulting solution has a pH of 13.1. A 6.463 gram scale sample from a fiberglass pipeline is placed into the solvent. The scale sample is composed of gypsum, ettringite ($Ca_6Al_2O_6(SO_4)_3 \cdot 31H_2O$), and quartz. The sample is treated with the solvent for a 24 hour period at 74° F temperature.

The contents of the test container are then filtered, and both the solution and residue are analyzed. The solution contains 0.4 pounds of gypsum per gallon of solvent,. The residue is composed only of quartz and ettringite.

The gypsum is leached from the deposit leaving behind a residue that has the appearance of consolidated sand that can be easily removed from the pipeline by flushing the pipeline with water.

EXAMPLE III 7.92 grams of methylhydroxamic acid are dissolved in 45.00 grams of water. 5.48 milliliters of a potassium hydroxide solution are titrated into the acid until the pH is 13.0. A dense gypsum cube approximately three-fourths of an inch on each edge and weighing 36.091 grams is placed in the treating solution and allowed to react for a 24-hour period at 125° F. At the end of the treating period the cube is removed from the solution and washed with distilled water. The block has lost 7.809 grams. The weight loss is due to two things. A sludge forms that is analyzed as klauzite. This klauzite precipitate accounts for 1.03 lbs of gypsum removed from the block per gallon of solvent. The solution analysis shows that 0.26 lbs of gypsum per gallon of solvent is actually dissolved. Therefore, the methylhydroxamate solution shows the ability to dissolve and disperse a total of 1.29 lbs of gypsum per gallon of solvent.

Another treatment is conducted on a dense gypsum cube of approximately the same dimensions. The second solvent contains 10.00 grams of potassium acetate dissolved in 50.00 milliliters of water. This solvent only causes the gypsum block to lose 0.712 grams of material.

This invention is not limited to the above described specific embodiments thereof; it must be understood therefore that the detail involved in the descriptions of the specific embodiments is presented for the purpose of illustration only, and that reasonable variations and modifications, which will be apparent to those skilled in the art, can be made in this invention without departing from the spirit or scope thereof.

Having thus described the invention, that which is claimed is:

1. A method for dissolving gypsum comprising contacting said gypsum with a solvent composition consisting essentially of water and an agent selected from the group consisting of a hydroxamic acid, represented by the formula

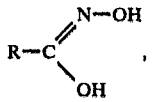

an alkali metal salt of said hydroxamic acid, an amine salt of said hydroxamic acid, an alkanol amine salt of said hydroxamic acid and mixtures thereof wherein R is selected from hydrogen, alkyl groups having 1 to 10 carbon atoms and the group

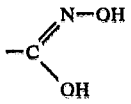

and further wherein said salts are those derived from the reaction of said acid with alkali metal hydroxides, ammonia, ammonium hydroxide, ethylenediamine, monoethylamine, monomethylamine, monoethanolamine, diethanolamine, triethanolamine and mixtures thereof.

2. The method of claim 1 wherein said contacting is conducted at a temperature in the range of from about 60° F to about 200° F, and wherein the pH of said aqueous solvent is adjusted to a value in the range of about 7 to about 14 with a pH adjusting material compatible with said agent.

3. The method of claim 2 wherein said agent is present in said solvent composition in the range of about 1 to about 50 parts by weight of said agent per 100 parts by weight of said solvent composition.

4. The method of claim 3 wherein said hydroxamic acid contains in the range of from 1 to 11 carbon atoms and said salts are those derived from the reaction of said acid with compounds selected from the group consisting of ammonia, ammonium hydroxide, ethylenediamine, sodium hydroxide, potassium hydroxide, monoethyl amine, monomethyl amine, diethanol amine, triethanol amine and mixtures thereof.

5. The method of claim 4 wherein said pH adjusting material is selected from the group consisting of alkali metal hydroxides, basic amines, and mixtures thereof.

6. The method of claim 5 wherein said hydroxamic acid contains in the range of from 2 to 6 carbon atoms and said agent is present in said solvent composition in the range of about 10 to about 40 parts by weight of said agent per 100 parts by weight of said solvent composition.

7. The method of claim 6 wherein said contacting is conducted at a temperature in the range of from about 100° F to about 150° F and said pH is adjusted to a value in the range of about 10 to about 13.5.

8. The method of claim 7 wherein said agent is potassium methylhydroxamate present in said solvent in the amount of about 20 parts by weight per 100 parts by weight of solvent and wherein the pH of said solvent is adjusted with potassium hydroxide to a value of about 13 and said contacting is conducted at a temperature of about 125° F.

9. The method of claim 8 wherein said gypsum contacted is in the form of a deposit on equipment and said contacting is maintained for a time sufficient to dissolve and/or to disintegrate said deposit.

10. The method of claim 1 wherein said agent is represented by the general formula

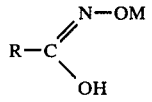

wherein R is selected from hydrogen, alkyl groups having 1 to 10 carbon atoms and the group

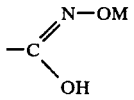

and M is selected from hydrogen, alkali metals, ammonium, and ethylenediamine.

* * * * *